United States Patent [19]

Johansson

[11] 4,338,074

[45] Jul. 6, 1982

[54] FLUIDIZED BED COMBUSTION CHAMBERS

[75] Inventor: Lars-Göran Johansson, Finspong, Sweden

[73] Assignee: Stal-Laval Turbin AB, Finspong, Sweden

[21] Appl. No.: 118,010

[22] Filed: Feb. 4, 1980

Related U.S. Application Data

[63] Continuation of Ser. No. 916,039, Jun., 1978, abandoned.

[51] Int. Cl.[3] ..... F23D 19/00

[52] U.S. Cl. ..... 431/6; 431/7; 431/115; 122/4 D

[58] Field of Search ..... 431/6, 7, 170, 115, 431/116; 122/4 D; 432/15, 58; 110/243, 245; 34/10, 57 R, 57 A

[56] References Cited

U.S. PATENT DOCUMENTS

| | | | |
|---|---|---|---|
| 3,048,153 | 8/1962 | Abrahamsen | 122/4 D |
| 3,387,590 | 6/1968 | Bishop | 122/4 D |
| 3,736,908 | 6/1973 | Ehrlich et al. | 122/4 D |
| 3,921,590 | 11/1975 | Mitchell et al. | 122/4 D |
| 3,996,863 | 12/1976 | Osborn | 122/4 D |

*Primary Examiner*—Samuel Scott
*Assistant Examiner*—Lee E. Barrett
*Attorney, Agent, or Firm*—Pollock, Vande Sande & Priddy

[57] ABSTRACT

An assembly and method for heating a fluidized bed combustion chamber to ignition temperature, wherein a heated gas flows through heat exchange tubes extending into the fluidized bed to provide sufficient heat for raising the temperature of the bed material and the combustion air to allow for ignition of the combustion fuel. A conduit system is provided for selectively recycling combustion air through the combustion chamber during the ignition process.

6 Claims, 2 Drawing Figures

FLUIDIZED BED COMBUSTION CHAMBERS

This is a continuation of application Ser. No. 916,039, filed 6/16/78, now abandoned.

BACKGROUND OF THE INVENTION

The present invention generally relates to a combustion chamber of the type including a fluidized bed. In particular, the present invention is directed to an assembly for initially heating the fluidized bed through the use of a hot gas flowing in heat exchanger tubes extending through the fluidized bed.

It is well known that a fluidized bed material must be heated to a temperature in the vicinity of the fuel ignition temperature before ignition can be accomplished. A known fluidized bed combustion chamber employs a separate heating device for supplying a heated gas, usually air, into the combustion chamber in the same direction in which the combustion air is supplied. This known combustion chamber has proven less than satisfactory in requiring the special heating device which serves a limited function while considerably increasing the operating cost.

As will be discussed in detail hereafter, applicant's new and useful invention solves the problem facing known fluidized bed combustion chambers with a combustion chamber including a simple and inexpensive assembly for supplying superheated steam capable of sufficiently heating the bed material to allow for ignition.

OBJECTS AND SUMMARY OF THE PRESENT INVENTION

An object of the present invention is to provide an assembly and method for igniting a fluidized bed combustion chamber, wherein a heated fluid medium is caused to flow through heat exchanger tubes extending into the fluidized bed.

A further object of the present invention is to provide an assembly and method for igniting a fluidized bed combustion chamber, wherein a combustion gas is caused to recirculate through the combustion chamber, via a closed passageway controlled by a plurality of valves which function in response to a thermostatic sensor positioned within the combustion chamber.

Another object of the present invention is to provide an ignition assembly which is inexpensive to manufacture and easy to install.

Each of the preceding objectives is achieved in a preferred embodiment of the present invention, wherein a plurality of nozzles separate a first chamber and a fluidized bed combustion chamber positioned thereabove. Heat exchanger tubes extend into the fluidized bed in a manner similar to the superheater tubes described in copending U.S. application Ser. No. 720,527, now U.S. Pat. No. 4,085,593, which is assigned to the same assignee as the present application and which is incorporated by reference thereto.

A fluid conduit system extends between opposite ends of the chamber with control valves and a circulating fan appropriately positioned within the conduit system. Superheated steam flowing through the heat exchanger tubes heats the fluidized bed to the ignition temperature of the specific fuel, with heated air circulating through the closed conduit system to provide for combustion of the fuel. The present invention avoids the necessity of continuously heating large amounts of fresh air for passage through the combustion chamber by use of the control valves.

A better understanding of the present invention will become apparent from a reading of the following specification and claims, together with the accompanying drawings, wherein similar elements are referred to and are indicated by similar reference numerals.

BRIEF DESCRIPTION OF THE DRAWING

The present invention can be best understood with reference to the accompanying drawing wherein.

DETAILED DESCRIPTION OF A PREFERRED EMBODIMENT

Figure 1:
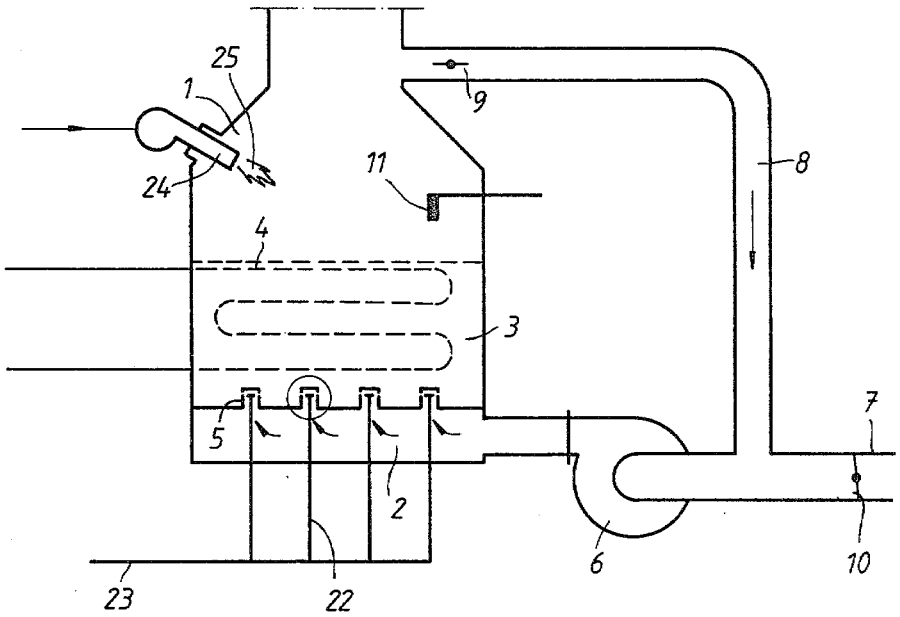
FIG. 1 depicts a schematic representation of a fluidized bed combustion chamber according to the present invention; and, FIG. 2 shows on an enlarged scale a portion of the preferred embodiment of FIG. 1.

Referring to FIG. 1, a combustion chamber is generally indicated at 1. A separate chamber 2 is positioned beneath combustion chamber 1 and is in fluid contact therewith via a plurality of through nozzles 5. Combustion air is injected into chamber 2, and through nozzles 5 into chamber 1 in a manner to be described hereafter. A fluidized bed 3, as described in the previously referred to copending U.S. application Ser. No. 720,527, now U.S. Pat. No. 4,085,593, is arranged within combustion chamber 1. See also U.S. application Ser. No. 835,927, now abandoned.

Heat exchange tubes 4 extend through fluidized bed 3, with one end of tubes 4 being attached to a source of hot gas, such as a steam boiler exhaust capable of supplying superheated steam at temperatures of up to 500° C. As the superheated steam is blown through tubes 4, it heats the fluidized bed to a temperature sufficient for combustion of the fuel, either directly or with the aid of a separate igniter.

Figure 2:
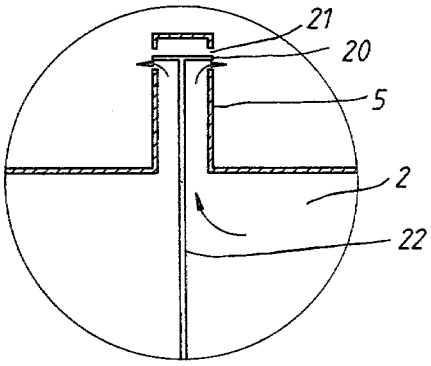

Referring again to the drawing, an assembly for providing combustion air during ignition will now be described. Combustion air is initially provided through a conduit 7 and into a fan 6 which injects the air into chamber 2. As best shown in FIG. 2, each of the air nozzles 5 encloses a conventional fuel nozzle 20, with each fuel nozzle 20 having an opening adjacent to an opening 21 of a surrounding air nozzle. The fuel nozzles 20 may be connected to a fuel source via a conventional conduit assembly 22 attached to a common fuel feeding tube 23. A further circulating conduit 8 extends between an exhaust wall of combustion chamber 1 and into attachment with conduit 7, at a position between fan 6 and a control valve 10 positioned in conduit 7. A further control valve 9 is positioned in a portion of conduit 8 adjacent to the exhaust of combustion chamber 1. Finally, a thermostat 11 is suitably positioned within combustion chamber 1.

During the ignition process, heat exchanger tubes 4 are supplied with a heated gas, such as air, from a conventional source, such as a steam boiler. Fan 6 is actuated with valve 9 being set in an open position and valve 10 set in a closed position. As a result, combustion air injected by fan 6 through nozzles 5, is heated by flowing past tubes 4, while fluidized bed 3 is also being heated via tubes 4. The combustion air then passes through circulating conduit 8 and back to fan 6 to begin the cycle again. The air and the bed material in combustion chamber 1 is heated to a temperature at least above the point of inflamation of the fuel, which is preferably around, or possibly above, the auto ignition temperature of the fuel supplied via nozzles 20, causing the fuel to be ignited directly by the heated bed material. If the inflamation temperature of the fuel is below the ignition temperature, the fuel may be easily ignited with the aid of a pilot flame or, more preferably, an electric spark. Such a pilot flame is shown at 25 and is conventionally generated by an ignition burner such as indicated by numeral 24.

When the ignition temperature has been achieved, valve 9 is closed and valve 10 opened to provide a continuous supply of combustion air to combustion chamber 1. Thermostat 11 may be positioned to sense when the ignition temperature is achieved, and to automatically operate valves 9 and 10 as discussed hereabove. Thermostat 11 may also be used as a flame detector for sensing whether ignition has taken place.

In an alternative embodiment, the combustion chamber 1 is supplied with pressurized combustion air from a compressor (not shown) connected to conduit 7. In such a case, fan 6 should be placed in conduit 8 to avoid damage.

The present invention is not limited to the above described embodiments, but is to be limited only by the scope of the following claims.

What I claim is:

1. A method of initially heating a fluidized bed combustion chamber to a temperature sufficient to promote ignition and combustion of a fuel introduced into the fluidized bed combustion chamber, comprising the steps of:

circulating a superheated fluid through a heat exchange conduit having a portion immersed in a material forming a fluidized bed in said fluidized bed combustion chamber;

circulating a gas in a substantially vertically upward direction through said fluidized bed and into a bypass conduit in fluid communication with said fluidized bed combustion chamber;

circulating said gas through said bypass conduit and into a separate chamber positioned substantially beneath said fluidized bed;

forcing said gas from said separate chamber into a vertically lower portion of said fluidized bed in said fluidized bed combustion chamber to complete a closed cycle; and introducing a quantity of fuel into said fluidized bed adjacent said gas.

2. A method according to claim 1, including the further step of closing a valve positioned in an entry way of said bypass conduit in response to a thermostat sensing ignition of said fuel.

3. A method according to claim 1, including the further step of activating an ignition burner within said fluidized bed combustion chamber which establishes a pilot flame, to ensure proper ignition of said gas and fuel.

4. A method according to claim 1, including the further step of circulating air through said fluidized bed combustion chamber, said bypass conduit and said separate chamber.

5. A method according to claim 1, including the further step of circulating superheated steam through said conduit immersed in said fluidized bed combustion chamber.

6. A method according to claim 2, including the further step of opening a valve positioned in a conduit in fluid communication with a source of combustion air and said fluidized bed combustion chamber in response to said thermostate sensing ignition of said fuel.

* * * * *

UNITED STATES PATENT AND TRADEMARK OFFICE

CERTIFICATE OF CORRECTION

PATENT NO. : 4,338,074

DATED : July 6, 1982

INVENTOR(S) : Lars-Göran Johansson

It is certified that error appears in the above-identified patent and that said Letters Patent are hereby corrected as shown below:

On the Title page,

Foreign Application Priority Data

June 23, 1977 Sweden. . . . . .7707298-1

Signed and Sealed this

*Seventh* Day of *September 1982*

[SEAL]

*Attest:*

GERALD J. MOSSINGHOFF

*Attesting Officer*

*Commissioner of Patents and Trademarks*